US010751237B2

(12) United States Patent
Smith

(10) Patent No.: US 10,751,237 B2
(45) Date of Patent: Aug. 25, 2020

(54) LIFTING BRACKET

(71) Applicant: AUTOCHAIR LIMITED, Alfreton (GB)

(72) Inventor: Christopher Smith, Alfreton (GB)

(73) Assignee: AUTOCHAIR LIMITED, Alfreton (GB)

( * ) Notice: Subject to any disclaimer, the term of this patent is extended or adjusted under 35 U.S.C. 154(b) by 0 days.

(21) Appl. No.: 16/328,172

(22) PCT Filed: Aug. 25, 2017

(86) PCT No.: PCT/GB2017/052511
§ 371 (c)(1),
(2) Date: Feb. 25, 2019

(87) PCT Pub. No.: WO2018/037247
PCT Pub. Date: Mar. 1, 2018

(65) Prior Publication Data

US 2019/0290520 A1 Sep. 26, 2019

(30) Foreign Application Priority Data

Aug. 25, 2016 (GB) ..... 1614511.2

(51) Int. Cl.
*A61G 7/10* (2006.01)
*A61G 5/04* (2013.01)
(Continued)

(52) U.S. Cl.
CPC ..... *A61G 7/1048* (2013.01); *A61G 3/062* (2013.01); *A61G 3/063* (2013.01); *A61G 5/04* (2013.01);
(Continued)

(58) Field of Classification Search
CPC .... A61G 7/1048; A61G 7/1001; A61G 7/011; A61G 5/04; A61G 7/104; A61G 7/10;
(Continued)

(56) References Cited

U.S. PATENT DOCUMENTS 1,113,781 A * 10/1914 Griffin ..... G09F 7/18 248/230.8
2,990,151 A * 6/1961 Phillips ..... F16L 3/24 211/107
(Continued)

FOREIGN PATENT DOCUMENTS

CN 204701410 U 10/2015
DE 10232059 A1 2/2004

OTHER PUBLICATIONS

International Search Report, International Property Office, United Kingdom, GB Application No. 1614511.2, dated Mar. 1, 2017.
(Continued)

*Primary Examiner* — Nkeisha Smith
(74) *Attorney, Agent, or Firm* — Perkins IP Law Group LLC; Jefferson Perkins

(57) ABSTRACT

The present invention relates to a lifting bracket (1), in particular to a lifting bracket (1) for attaching to a mobility device such as a mobility scooter, power chair, or other electrically powered mobility device. The lifting bracket (1) comprises a main body (2) with a central portion and two side portions which extend away from the central portion. A connector (5), for connecting the body to a mobility device, is provided on a front edge (18) of the central portion of the body (2), and a mounting point (37) is provided at each end of the body (2) for attachment to a spreader bar. The body (2) is shaped such that each end of the body (2) is positioned forward of the front edge (18) of the central portion.

18 Claims, 4 Drawing Sheets

(51) Int. Cl.
*A61G 3/06* (2006.01)
*A61G 5/10* (2006.01)

(52) U.S. Cl.
CPC ..... *A61G 5/104* (2013.01); *A61G 7/1001* (2013.01); *A61G 7/10* (2013.01)

(58) Field of Classification Search
CPC ..... G09F 2007/1804; G09F 2007/1834; G09F 2007/1813; G09F 2007/1817; G09F 2007/1826; G09F 2007/183; G09F 2007/18; G01G 19/52; G01G 19/14; B66C 1/40
USPC ..... 248/188.1, 218.4, 219.2, 219.3, 219.4; 177/144, 147, 151, 255
See application file for complete search history.

(56) References Cited

U.S. PATENT DOCUMENTS 3,119,585 A * 1/1964 Austenson ..... A47G 33/1213 47/40.5
3,131,404 A * 5/1964 Bowers ..... A61G 7/1017 5/86.1
3,694,829 A * 10/1972 Bakker ..... A61G 7/1017 5/87.1
3,704,001 A * 11/1972 Sloop ..... H02B 5/02 248/219.4
4,170,368 A 10/1979 Southward et al.
4,309,263 A * 1/1982 Boyd ..... E02B 17/027 204/196.17
4,675,149 A * 6/1987 Perry ..... G21C 15/25 376/247
4,837,874 A * 6/1989 Giercarz ..... A61G 7/1019 5/84.1
4,918,771 A * 4/1990 James ..... A61G 7/1017 5/87.1
5,022,106 A * 6/1991 Richards ..... A61G 7/1017 4/254
5,630,236 A * 5/1997 Messin ..... A47K 17/02 297/DIG. 10
6,042,330 A * 3/2000 Egan ..... A61G 7/1017 212/237
6,329,612 B1 * 12/2001 von Schroeter ..... A61G 7/1019 177/144
6,367,103 B1 * 4/2002 Collins ..... A61G 7/1019 5/86.1
6,527,340 B1 3/2003 Finch et al.
6,663,065 B1 * 12/2003 Whittenburg ..... B66C 23/203 182/187
6,739,561 B2 * 5/2004 Herzog ..... H01Q 1/1221 248/218.4
6,768,474 B2 * 7/2004 Hunt ..... H01Q 1/1228 248/218.4
6,978,497 B1 * 12/2005 Takizawa ..... A61G 7/1019 5/86.1
7,346,941 B1 * 3/2008 Ein ..... A61G 7/1017 5/81.1 R
7,513,471 B2 * 4/2009 Moufflet ..... A47F 5/0892 248/218.4
9,084,709 B2 * 7/2015 Karlsson ..... B66C 1/12
9,217,535 B1 * 12/2015 Egan ..... A61G 3/02
9,332,748 B2 * 5/2016 Brown ..... A01M 31/02
2005/0189798 A1 9/2005 Strong
2005/0217024 A1 * 10/2005 Aarestad ..... A61G 7/1015 5/86.1
2016/0074266 A1 * 3/2016 Nakamoto ..... A61G 5/1094 224/272
2016/0128317 A1 * 5/2016 Gerry ..... A01M 31/02 248/217.3
2016/0354267 A1 * 12/2016 Masaki ..... A61G 5/00
2018/0344553 A1 * 12/2018 Lyckestig ..... A61G 7/1023

OTHER PUBLICATIONS

Ebay listing of scooter lifting bracket, www.ebay.co.uk, downloaded Jul. 3, 2017.
Autochair website selling The Olympian scooter and wheelchair hoist, www.autochair.co.uk, downloaded Jul. 3, 2017.
Written Opinion of the International Searching Authority, International Application No. PCT/GB2017/052511, dated Nov. 28, 2017.

* cited by examiner

LIFTING BRACKET

The present invention relates to a lifting bracket, in particular to a lifting bracket for a mobility device.

Lifting brackets are supplementary pieces of equipment that allow a mobility device such as a mobility scooter, power chair, or other electrically powered mobility device to be lifted using a vehicle mounted hoist via the use of a spreader bar. Brackets, which are used to attach the mobility device to the spreader bar, are usually supplied separately as a 'universal kit' allowing a competent installer to find a suitable attachment point on the mobility device and build a lifting bracket and subsequent lifting points using the kit.

Most commonly, the seat post is chosen as a lifting location because of the structural nature of the component and the relative ease of attaching a bracket. However, the usual location of the centre of mass of mobility devices is forward of the seat post, so the lifting points on the brackets must also be located forward of the seat post to ensure that the mobility device remains balanced during lifting. The simplest way to achieve this is to provide a bracket which extends forwardly of the seat post to a desired location. Since the precise centre of mass of different mobility devices can vary quite significantly (due to a number of specification variants and lifting configurations/positions), a form of sliding adjustment, extending directly forward from the seat post, is also typically provided.

The design of many mobility scooters and other mobility devices places the battery low down and fairly centrally, with the seat positioned above the battery towards the rear. As a result, the battery sits below the seat and in front of the seat post in many of these devices. A problem therefore arises with the typical mounting of lifting brackets discussed above, namely that the bracket/assembly commonly obstructs the battery from being removed and/or installed. Thus it is necessary to remove the lifting bracket from the mobility device every time the battery is removed and replaced, for example for charging or simply to substitute a second or spare battery for a period of prolonged use. Similarly, the forward mounting design of most lifting brackets can also impede or compromise the full collapse of the mobility device's tiller. A problem also exists with the amount of space available between the seat and the battery as most lifting brackets are bulky and can therefore compromise or prevent seat height adjustment and rotation.

There has now been devised an improved lifting bracket for mobility devices, which overcomes or substantially mitigates the above mentioned and/or other problems associated with the prior art.

According to a first aspect of the invention, there is provided a lifting bracket for a mobility device, said lifting bracket comprising a main body with a central portion and two side portions which extend away from the central portion to define a front edge, a rear edge and two ends of the body; a connector provided on the front edge of the central portion of the body for connecting the body to a mobility device; and a mounting point provided at each end of the body for attachment to a spreader bar; wherein the body is shaped such that each end of the body is positioned forward of the front edge of the central portion.

The lifting bracket of the invention mounts rearwards of the seat post (and thus avoids the battery completely) yet locates the lifting points in the same location as if the lifting bracket were mounted forward of the seat post, as with conventional solutions. The use of such a bracket allows a user of a mobility device with an accessible seat post to be able to remove the battery from the mobility device when necessary without the need to remove the lifting bracket. This is desirable as the user of the device, or any person aiding the user, does not have to be able to reinstall and adjust the bracket or require the help of someone who can. The space created by this arrangement also enables the tiller to pass through unimpeded and therefore can be collapsed completely.

The lifting bracket may be any suitable shape that allows the lifting bracket to be rear mounted but extend forward of the mounting point. For example, the bracket may be generally U-shaped or form an arc. In these cases, arms extend sideways and forward from the connector in opposing directions. Preferably the bracket is arcuate. In using an arcuate form, it is believed that the construction is stronger as there are no individual points of weakness. An arcuate or U-shaped form is particularly advantageous in creating the necessary space between the end plates L1 to enable the tiller to pass through and be collapsed completely.

Preferably the position of the mounting point is adjustable relative to the position of the connector at a point distant from the connector. Most preferably the position of the mounting points is adjustable at the ends of the main body.

Preferably the lifting bracket comprises a main body and adjustable end portions. In doing so, the main body may be a universal shape that is suitable for use with any mobility device and the end portions can be adjusted to fit the specific model of mobility device. This enables the costs of manufacturing to be kept as low as possible and to improve company branding/product families.

The end portions may vary in size so that the overall span of the lifting bracket can be adjusted. The lifting bracket will generally have a span that is slightly larger than the width of the seat of the mobility device to which the bracket will be applied. The width of the seats can vary by a significant amount. The end portion can therefore be chosen to increase the span appropriately.

The end portions may be connected to the main body by any suitable means. Preferably the end portions are removably connected to the main body, ie the end portions may be repeatedly connected and removed from the main body of the bracket. Preferably the end portions are bolted to the main portion via means of corresponding holes in the main body and end portions. Alternative one-piece design or fixing methods include straight pins, quick release pins, threaded inserts and the like.

The connection between the end portions and the main body may itself be adjustable so that the position of the end portions, and hence the mounting points, can be altered relative to the main body. For example, if the end portions are attached to the main body by a series of holes in either or both the main body and the end portions, then different holes may be aligned to provide a different overall span of the lifting bracket. The holes may be equally/evenly spaced.

If the connection between the end portions and the main body of the bracket is also adjustable, there are then multiple points on the lifting bracket where the positions of the mounting points may be adjusted. The shape of the bracket and therefore the location of the lifting points on the bracket may be more precisely optimised and also have a greater degree of flexibility. Thus the ability of the bracket to be used on a large range of mobility devices is maximised.

The mounting points may be adjustable relative to the point of attachment by any suitable means. The mounting points may comprise multiple openings in the bracket of approximately the same dimensions as a bolt or other suitable fixing means through which the bolt or other suitable fixing means may be placed and the mounting point can then be adjusted by selecting the appropriate opening. Alternatively, the lifting bracket may comprise one or more slots through which the bolt or other suitable fixing means can be passed. A slot has the advantage that the mounting point may be adjusted simply by loosening the fixing means and sliding it along the slot rather than having to remove the fixing means completely. The slot may be provided with a series of projections or indentations so that the same position may be easily selected in a repeatable manner, or may be a simple slot providing stepless adjustment of position. Preferably both ends of the lifting bracket are provided with the same adjustment means or a mirror image of the adjustment means of the opposing end. This allows both ends of the lifting bracket to be adjusted in the same manner. The fixing means may be a suitable bolt such as an eyebolt or any other alternative locking element, for example a karabiner, a quick release element, or a hook and loop fixing.

The ends of the lifting bracket are preferably shaped to allow for easy adjustment of the mounting points. For example, the ends may extend forward and back from the front and rear edges of the main body of the lifting bracket respectively. This allows for a greater degree of adjustability in the positioning of the mounting points. The ends may also extend upwards or downwards from the body of the lifting bracket. Depending on the application, this can facilitate attaching the spreader bar to the mounting points as the connecting means can be attached horizontally through the mounting point rather than vertically.

When the size of the end portion is varied in order to adjust the overall span of the lifting bracket as discussed above, the dimensions of the part of the end portion that extends between the point of attachment to the main body and the mounting point is preferably increased or decreased to provide the relevant adjustment.

The lifting bracket is attached to the mobility device by means of a connector. The connector is preferably designed to be attached to the seat post of the mobility device as the seat post has a shape that is convenient to attach to and is usually located centrally on the device.

The connector may utilise any suitable means for connecting the bracket to the seat post but preferably the connector comprises a resilient material that can deform around the seat post thus conforming to the shape of the seat post and holding the seat post firmly. The resilient material may be held in place removably, preferably via bolts placed through corresponding holes in the main body. Preferably the resilient material is in the form of a strip that can easily be deformed around the seat post.

The connector may be located on the main body adjacent to a corresponding indent in the main body. The indent may be semi-circular, V-shaped or any other suitable shape for accommodating a section of the seat post. Preferably the surface of the indent is not smooth, for example it may undulate or be irregular. In using an undulating or irregular surface, seat posts of different cross-sectional diameters may be held securely in the same indent. This enables the main body to again be a universal component for lifting brackets intended for use with different mobility devices. In a particularly preferred embodiment, the undulating surface results from being produced by successive semi-circular cuts of differing diameter.

The lifting bracket may be constructed in any suitable manner. Preferably the main body of the lifting bracket is laminar and constructed from layers of a suitable material which are connected to one another. Most preferably the main body is constructed from sheets of steel that are welded together.

By using a laminar construction, greater flexibility in the overall shape of the bracket can be achieved as each layer can be shaped differently. In addition, by using layers of a particular material, the bracket can also be significantly thinner in vertical (in use) cross-section than if an alternative method is used, such as a tubular construction. This allows the bracket to be considerably less bulky than currently available lifting brackets. Preferably the main body of the bracket has an overall thickness of less than 30 mm, preferably less than 20 mm. Most preferably the main body has a thickness of approximately 16 mm.

In particularly preferred embodiments, the laminar construction of the main body comprises at least three layers and the outer layers are larger in envelope size than at least one of the inner layers. This provides an overlap when the layers are stacked on one another which results in the main body having spaces between the outer layers which are the thickness of the inner layer. If appropriately shaped, the end portions of the bracket may be inserted into these spaces. This allows for a simple and secure connection point between the end portions and the main body.

Any of the optional features described in relation to any single aspect of the invention may be applied to any other aspect of the invention.

An embodiment of the invention will now be described in greater detail, by way of illustration only, with reference to the accompanying drawings, in which FIG. 1 is a perspective view of a lifting bracket and spreader bar of the prior art;

Figure 1:
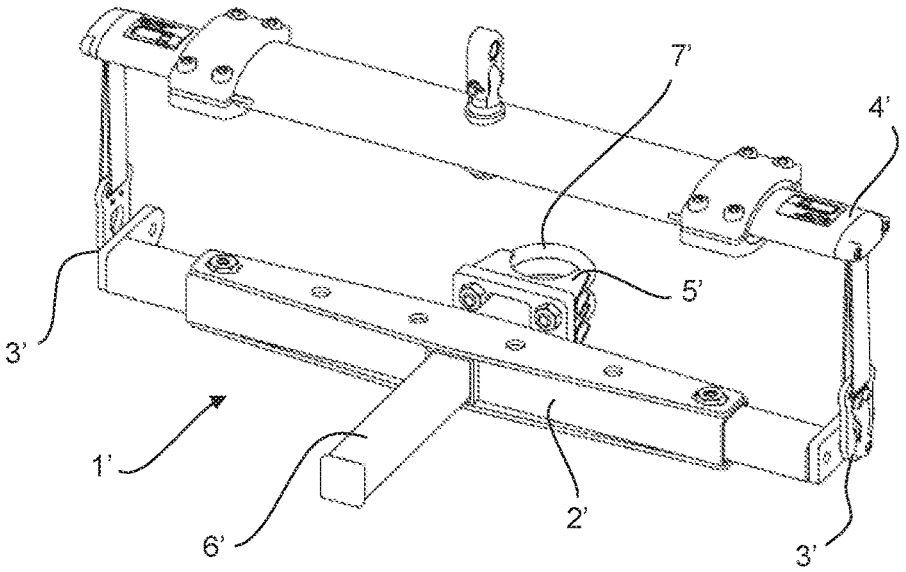

An example of a known lifting bracket is shown in FIG. 1. The bracket 1' is mounted forward of the seat post and generally comprises a main body 2' with attachment points 3' located at either end of the main body for a spreader bar 4', and a central connector 5' for mounting the bracket 1' to the seat post of a mobility scooter. The central connector 5' comprises a pair of rigid horseshoe shaped members 7' which are placed around the seat post in use.

The position of the main body 2' and hence the attachment points 3' is adjustable by means of a projection 6' which extends forwardly from the central connector 5' and through the main body 2'. The main body 2' may be slid forward and back along the projection 6' in order to adjust the position of the main body 2' and hence the attachment points 3' relative to the centre of gravity of the mobility scooter. In use, this projection 6' extends over the battery compartment of the mobility device thus preventing access to the battery whilst the bracket is in position.

Figure 2:
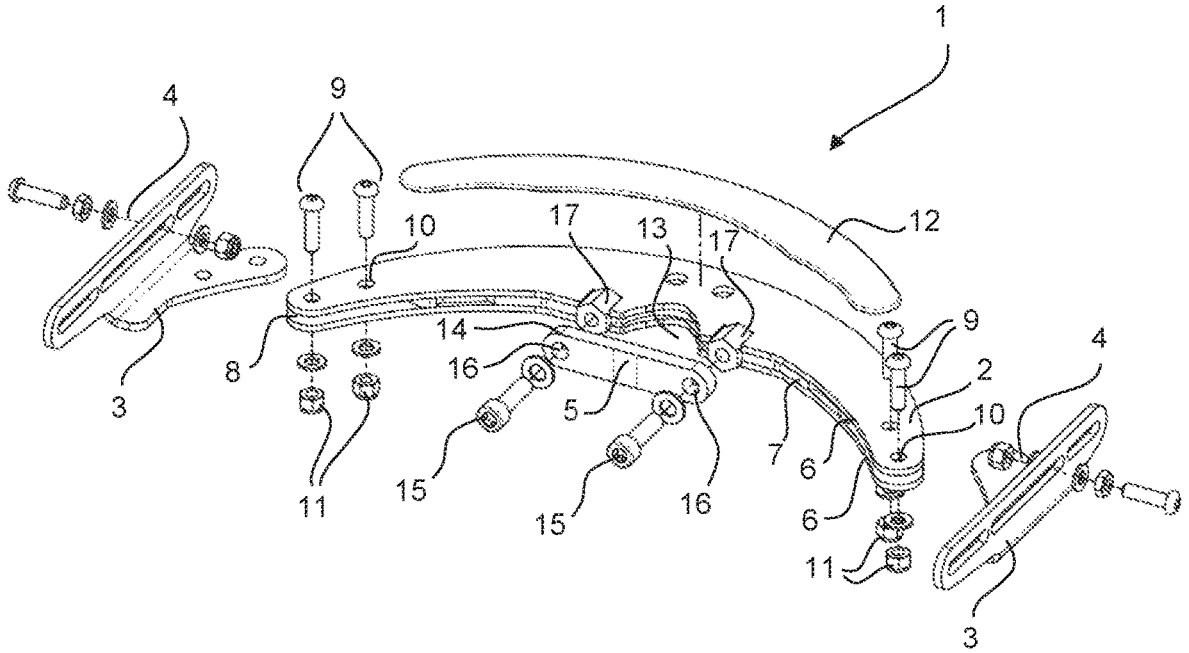
FIG. 2 is a part exploded perspective view of a lifting bracket according to the invention.

FIG. 2 shows a part exploded view of a lifting bracket 1 according to the present invention. The lifting bracket 1 generally comprises an arcuate main body 2, two adjustable end sections 3 positioned at either end of the main body, providing attachment points 4 for a spreader bar, and a central connector 5 for mounting the bracket 1 to the seat post of a mobility scooter.

The main body 2 is laminar and constructed from three layers of low-carbon sheet steel, two arcuate principal or outer layers 6 and a shorter arcuate inner layer 7 that is sandwiched between the two principal layers 6 such that a space 8 or gap is provided between the two principal layers 6 at each end of the main body 2. The spaces 8 between the two principal layers 6 allow a portion of each end section 3 to be inserted between the principal layers 6 of the main body 2 and held in place via a series of threaded bolts 9 that are passed through corresponding holes 10 in the end sections and the arcuate main body, and held in place with nuts 11.

A thin pad 12 constructed from polyurethane resin is applied to the top face of the uppermost layer 6 of the main body 2. The pad 12 is arcuate in form and of slightly smaller dimensions than the principal layers 6 of the laminar main body 2. The pad 12 improves the overall appearance of the bracket.

The connector 5 is located centrally on the inside of the arc of the main body 2, adjacent to a generally semi-circular indent 13 formed in the main body 2. The generally semi-circular indent 13 is formed from aligned cut-outs in the three sheet steel layers 6,7 making up the main body 2. The connector 5 comprises a resilient 10 mm thick stainless steel strip 14 that is connected to the main body 2 by a pair of bolts 15 located through holes 16 formed in respective ends of the strip and received in threaded fixing points 17 provided in the main body 2 on either side of the semi-circular indent 13. The fixing points 17 are provided by a pair of large hexagonal nuts that are welded to the main body.

Figure 3:
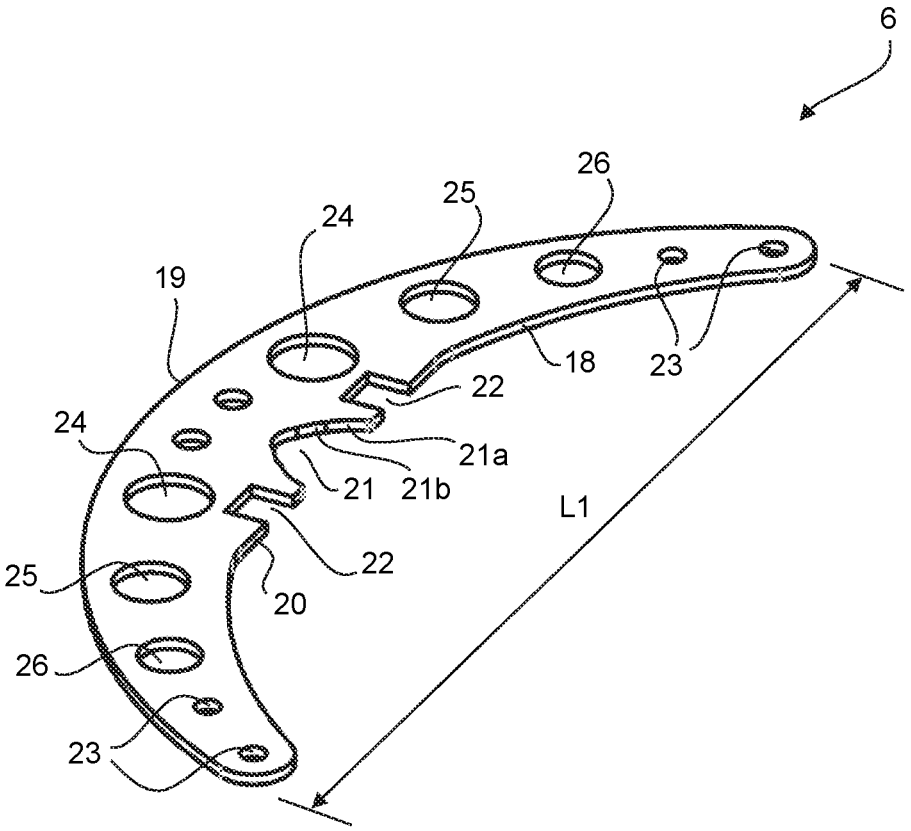
FIG. 3 is a perspective view of an arcuate principal or outer layer of the main body of the lifting bracket of FIG. 2.

FIG. 3 shows a principal layer 6 in isolation. The principal layer 6 is laser cut from 4 mm sheet steel, and is generally arcuate in shape, having inner 18 and outer 19 generally curved edges. The inner edge 18 forms the front edge of the bracket, and has a straight section 20 in its centre. A rounded cut-out 21 is provided in the centre of the straight edge section, and a rectangular cut-out 22 is provided on either side of the rounded cut-out 21. The rounded cut-out 21 is provided by performing successive semi-circular cuts of differing diameter. The result is a cut-out 21 that is generally semi-circular, but has an undulating inner profile with differing radii. As shown, the largest cut 21*a* has a 50 mm diameter, and the second cut 21*b* has a 38 mm diameter. By having differing radii of cuts, the rounded cut-out/indent 21 can receive and hold securely seat posts of differing diameters.

A pair of holes 23 is provided at each end of the principal layer 6 to receive bolts to fix the end sections 3 in place. Additional holes 24,25,26 are provided in the principal layer 6 primarily to reduce weight. The length L1 between opposite ends of the principal layer 6 is approximately 400 mm.

Figure 4:
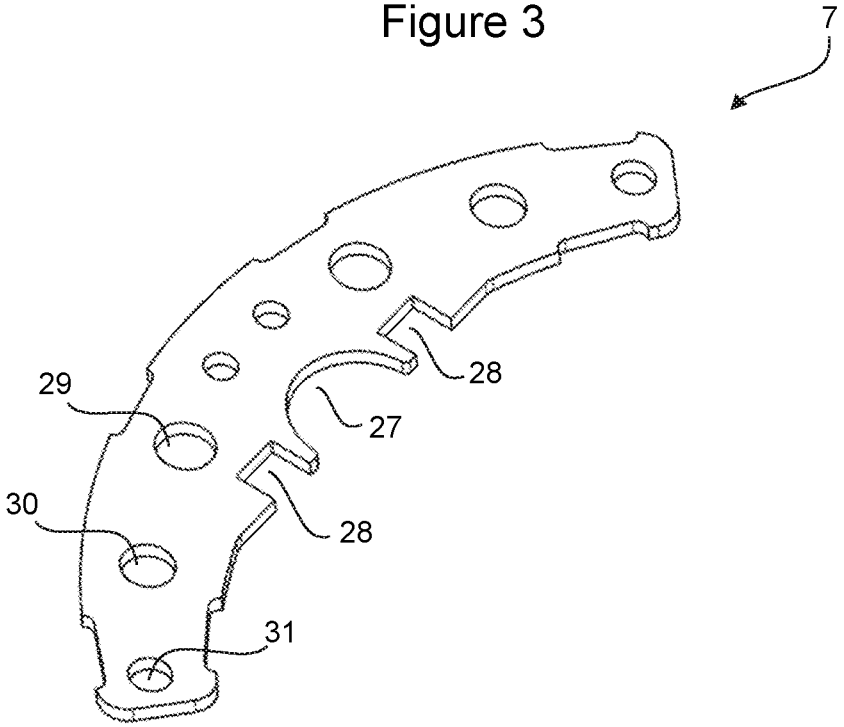
FIG. 4 is a perspective view of the arcuate inner layer of the main body of a lifting bracket of FIG. 2.

FIG. 4 shows the shorter inner layer 7 in isolation. The inner layer 7 is shaped to correspond to the centre portion of the principal layer 6, and is laser cut from 6 mm sheet steel. Accordingly, when the principal layers 6 and inner layer 7 are sandwiched together the thickness of the gap/space 8 provided at each end of the main body 2 is 6 mm. The inner layer 7 also comprises a generally semi-circular cut out 27, of 52 mm diameter, in its front edge and a pair of rectangular cut-outs 28 to align with those provided in the principal layer 6. Once assembled with the two principal layers 6, the rectangular cut-outs 28 provide locations for securing the large hexagonal nuts 17 which provide the fixing points for the connector. The generally semi-circular cut out 27 in the inner layer 7 is larger than that in the principal layers 6. This means that this cut out does not interfere with the undulating profile of the cut out 21 in the principal layers 6. Holes 29,30,31 are provided, as in the principal layer, to reduce the weight of the component.

Figure 5:
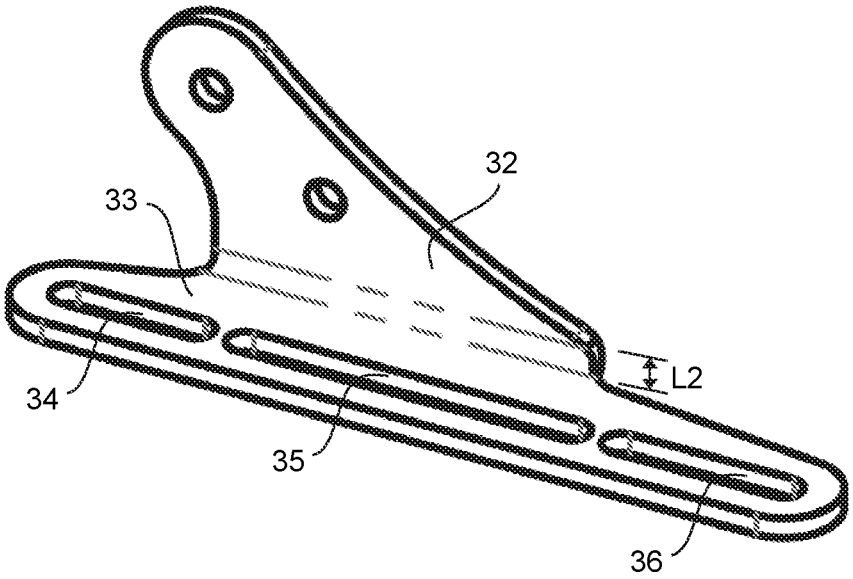
FIG. 5 is a perspective view of an end portion of the lifting bracket of FIG. 2.

An end portion 3 is illustrated in isolation in FIG. 5. Each end portion 3 is L-shaped in cross-section, the L-shape having a first part 32 that secures the end portion to the main body 2 as discussed above, and a second part 33 that extends perpendicular to the first part.

The first part 32 of each end section 3 is, in use, inserted between the principal layers 6 that form the main body 2 and thus extends parallel to the plane of the main body 2 in use. Each end portion 3 is laser cut from 5 mm stainless steel sheet, so the 6 mm gaps 8 provided in the body portion 2 provide some clearance for the insertion of the first part 32 of each end portion 2.

The length marked L2 in FIG. 5 may be made greater or smaller in size in other end portions according to the invention. By varying the size of this portion, the span of the lifting bracket 1 may be adjusted as required.

The second part 33 of the end section 3 extends upward (but may equally extend downwards if appropriate) in use and horizontally both in front and behind the point at which the first part 32 is attached to the main body 2 of the bracket 1. The second part 33 of each end portion 3 also comprises a series of three slots 34,35,36 which extend horizontally along the length of this second part. A hanging bolt 37 (shown in FIG. 7) for connecting the bracket to the spreader bar can be received through one of the slots 34,35,36 in each end portion 3 as indicated in the exploded view of FIG. 2. In use, straps hanging from the spreader bar of a hoist or similar lifting device/mechanism are hooked or otherwise attached to the hanging bolts 37 in the respective end portions 3 to lift the mobility device.

Figure 6:
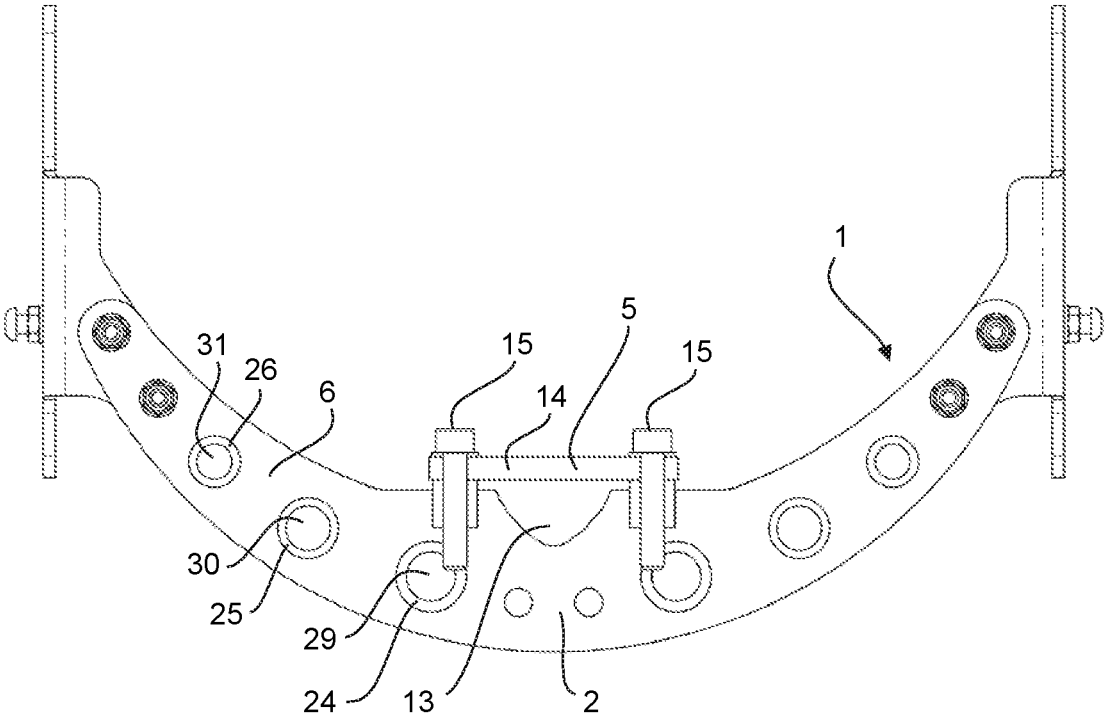
FIG. 6 is a plan view of the underside of the lifting bracket of FIG. 2.

FIG. 6 shows the underside of the assembled lifting bracket 1 ready for attachment to the seat post of a mobility scooter. From this view it can be seen that the holes in both the outer and inner arcuate layers (24,25,26 in 6 and 29,30,31 in 7) are aligned. The overall width of the bracket corresponds to the length L1 plus twice the length L2 and can therefore be varied by varying the length L2 to give the required width for a particular mobility device. The overall span of the lifting bracket also corresponds generally to the width of the required spreader bar which can vary between about 400 mm and about 650 mm.

In use, the bracket 1 is connected to the seat post of the relevant mobility device by removing the stainless steel strip 14 from the bracket 1 by undoing the bolts 15, placing the main body 2 behind the seat post and the strip 14 in front of the seat post and reapplying the bolts 15. The resilience of the stainless steel strip 14 allows the strip 14 to deform about the seat post and hence hold the bracket 1 in place. The different cut diameters making up the generally semi-circular indent 13 provide a profile which allows the connector 5 and indent 13 to provide a strong grip on seat posts of a range of different circumferences.

Figure 7:
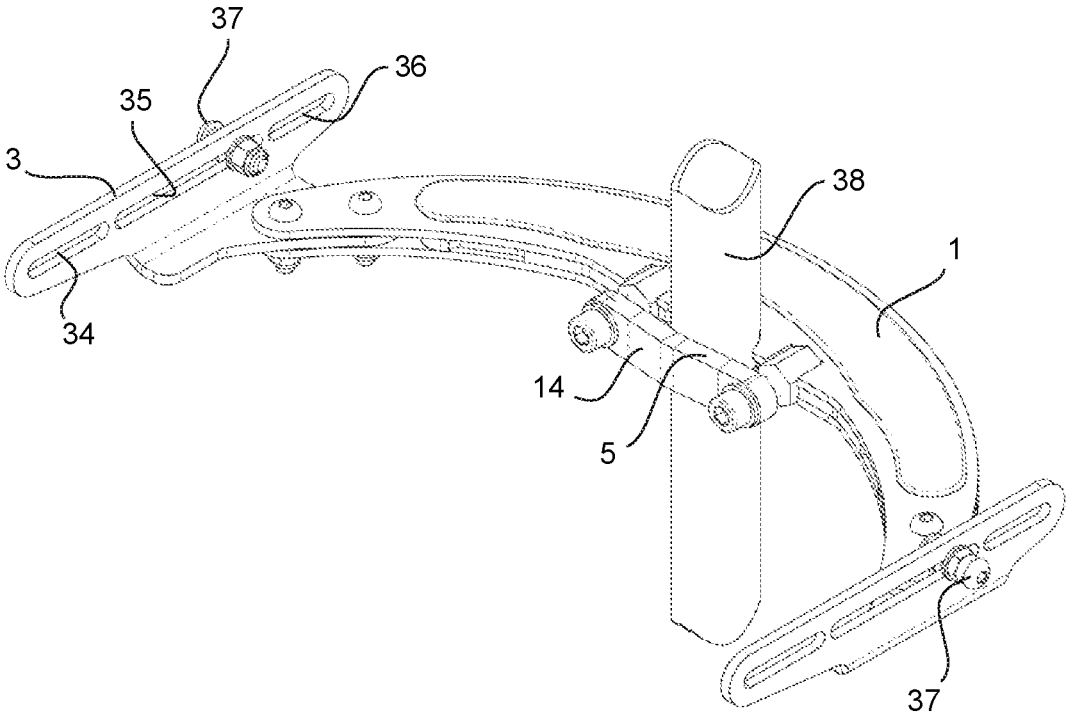
FIG. 7 is a perspective view of the lifting bracket of FIG. 2 applied to a seat post.

FIG. 7 shows the lifting bracket 1 attached to the seat post 38 of a mobility scooter.

The hanging bolts 37 are shown passing through the central slot 35 in each end portion 3, but may be placed in any of the slots depending on the general centre of mass and balance point of the mobility device to be lifted. Finer adjustments may then be made by sliding the bolt 37 along the respective slots 34,35,36 to allow the point at which the spreader bar is attached to the bracket 1 to be precisely adjusted relative to the position of the seat post 38 and hence also relative to the centre of mass of the mobility device.

The strip 14 of the connector 5 can be seen to have deformed about the seat post 37. By deforming, the strip 14 is able to hold seat posts 37 of differing diameters securely.

Figure 8:
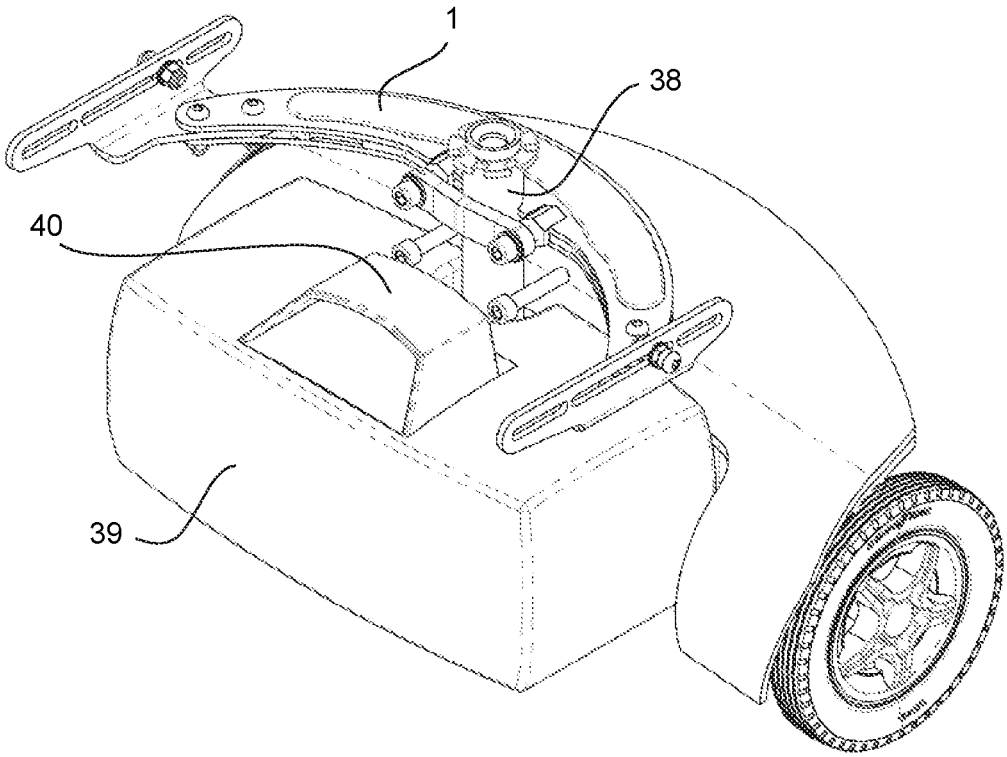
FIG. 8 is a perspective view of the lifting bracket of FIG. 2 applied to a seat post of a mobility device and relative to the battery compartment.

FIG. 8 shows the lifting bracket 1 attached to the seat post 38 of a mobility scooter with the position of the battery 39 of the mobility scooter shown. The position of the lifting bracket 1 does not interfere with removal or replacement of the battery 39. In particular, a handle 40 provided on the top of the battery 39 is easily accessible while the bracket 1 is attached to the seat post 38.

Although described above in specific terms, it will be understood that certain changes can be made to the invention without departing from the scope of the appended claims. In particular, the dimensions and materials provided are indicative, based on a particular application of the invention, and are not intended to limit the protection sought.

Although certain materials are described, it will be appreciated that similar materials may be substituted without adversely affecting the operation of the bracket of the invention. For example, the low-carbon steel and stainless steel components could instead be formed from other suitable metals, ceramics or even plastics having the necessary strength and resilience for example, metal composites, polymer composites (or a combination of either or both with non-alloyed or composite material(s) or aluminium for weight saving. Other suitable substitute materials would be familiar to a skilled reader.

Similarly, the precise shape of the various components shown and the overall bracket may vary. For example, a bracket may be provided having a more pronounced curve or may even comprise a generally straight central portion and generally straight arms extending at an angle forward of the front edge. The end portions could also be formed in a different shape, and indeed it may be desirable for a variety of different end portions to be provided to account for different applications of the invention.

In addition, the means by which individual components are connected to one another in the manufacturing process may vary. For example, the hexagonal bolts may be threaded into the main body rather than welded to the main body. Suitable connection means will be understood by the person skilled in the art.

The invention claimed is:

1. A mobility scooter lifting bracket, said lifting bracket comprising:

a main body with a central portion and two side portions which extend away from the central portion to define a front edge, a rear edge and two ends of the body;

a connector provided on the front edge of the central portion of the body for connecting the body to a seat post of a mobility scooter; and a mounting point provided at each end of the body for attachment to a spreader bar, a position of each of the mounting points being adjustable, relative to a position of the connector, at the ends of main body;

wherein the body is shaped such that each end of the body is positioned forward of the front edge of the central portion.

2. A lifting bracket according to claim 1 wherein the main body has an arcuate form.

3. A lifting bracket according to claim 1 wherein the bracket further comprises separate end portions.

4. A lifting bracket according to claim 3 wherein the end portions are removably connected to the main body.

5. A lifting bracket according to claim 4 where a connection between the end portions and the main body is adjustable.

6. A lifting bracket according to claim 1 wherein the mounting point comprises one or more slots through which a bolt may be placed.

7. A lifting bracket according to claim 1 wherein the ends of the bracket extend forward and back from the front and rear edges of the main body of the lifting bracket respectively.

8. A lifting bracket according to claim 1 wherein the ends of the bracket extend upwards from the main body of the lifting bracket.

9. A lifting bracket according to claim 1 wherein the ends of the bracket extend downwards from the main body of the lifting bracket.

10. A lifting bracket according to claim 1 wherein the connector comprises a resilient material.

11. A lifting bracket according to claim 10 wherein the connector comprises a resilient strip.

12. A lifting bracket according to claim 1 wherein an indent is provided on the front edge of the main body adjacent to the connector.

13. A lifting bracket according to claim 12 wherein the indent is generally semi-circular.

14. A lifting bracket according to claim 13 wherein the surface of the indent is irregular or undulating.

15. A lifting bracket according to claim 14 wherein the indent is formed by successive semi-circular cuts of differing diameters.

16. A lifting bracket according to claim 1 wherein a major proportion of the main body has a thickness of less than 30 mm.

17. A lifting bracket according to claim 16 wherein a major proportion of the main body has a thickness of less than 20 mm.

18. A lifting bracket according to claim 1 wherein the position of each mounting point is adjustable in a fore-and-aft direction.

* * * * *